US005402746A

United States Patent [19]

Deschamps

[11] Patent Number: 5,402,746

[45] Date of Patent: Apr. 4, 1995

[54] FLAGSTAFF FOR HOLDING THE FLAG UNFURLED

[76] Inventor: Frederic Deschamps, Carrefour Varoise, 83700 Saint-Raphael, France

[21] Appl. No.: 78,501

[22] Filed: Jun. 18, 1993

[30] Foreign Application Priority Data

Jun. 24, 1992 [FR] France ..... 92 07730

[51] Int. Cl.[6] ..... G09F 17/00

[52] U.S. Cl. ..... 116/174

[58] Field of Search ..... 40/601, 604; 116/68, 116/173, 174; 248/332

[56] References Cited

U.S. PATENT DOCUMENTS

| | | | |
|---|---|---|---|
| 632,580 | 9/1899 | Macartney | 116/174 |
| 1,061,041 | 5/1913 | Buckley | 116/174 |
| 1,712,691 | 5/1929 | Carlson | 116/174 |
| 2,507,623 | 5/1950 | Diaz | 116/174 |
| 3,323,486 | 6/1967 | Woolf | 116/173 |
| 4,791,878 | 12/1988 | Lewis | 116/173 |

FOREIGN PATENT DOCUMENTS

| | | | |
|---|---|---|---|
| 0114519 | 11/1900 | Germany | 116/173 |
| 40011916 | 7/1991 | Germany | 116/173 |
| 0018205 | of 1897 | United Kingdom | 116/173 |

*Primary Examiner*—William A. Cuchlinski, Jr.
*Assistant Examiner*—Willie Morris Worth
*Attorney, Agent, or Firm*—Nath, Amberly & Associates

[57] ABSTRACT

A flagstaff and flag for displaying the flag unfurled in the absence of wind. The flagstaff includes a mast and an attached boom, and a housing with flared spacers underneath the boom. The boom can be attached to a rotary head atop the mast, with openings in the boom, head and mast for a halyard to pass through. The flag is equipped with a head bar to which one end of a halyard is attached. The flag has sliding rings on the side adjacent to the mast and these rings pass around the mast. The flag is raised into position beneath the boom by the halyard which runs from the head bar to the boom and then to the foot of the mast. The head bar may be either outside of the flag or a shaped piece fitting over a rope sewn into the hem of the flag. When in the raised position the head bar rests against flared members in the housing for stability.

16 Claims, 3 Drawing Sheets

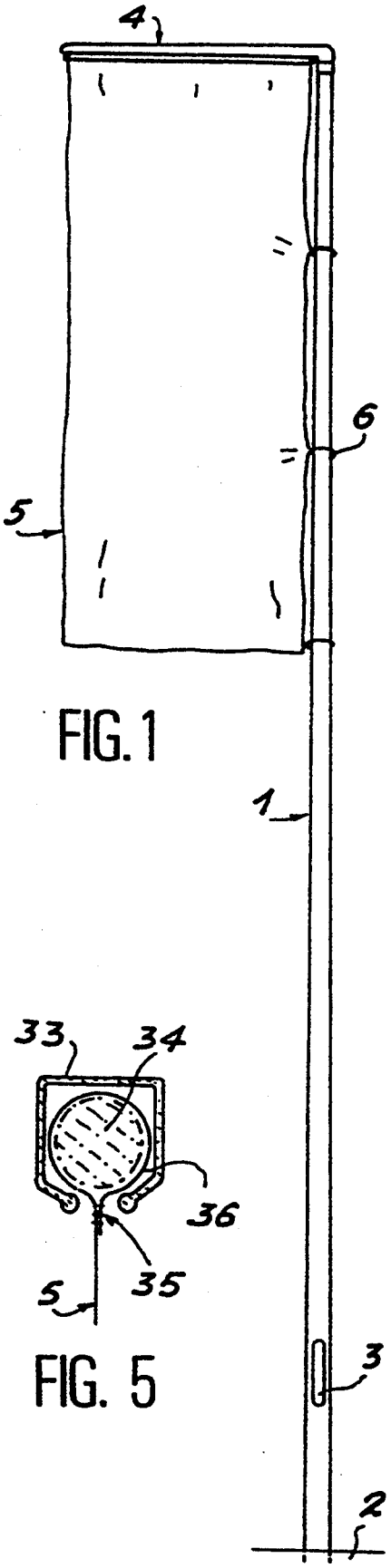
FIG. 1
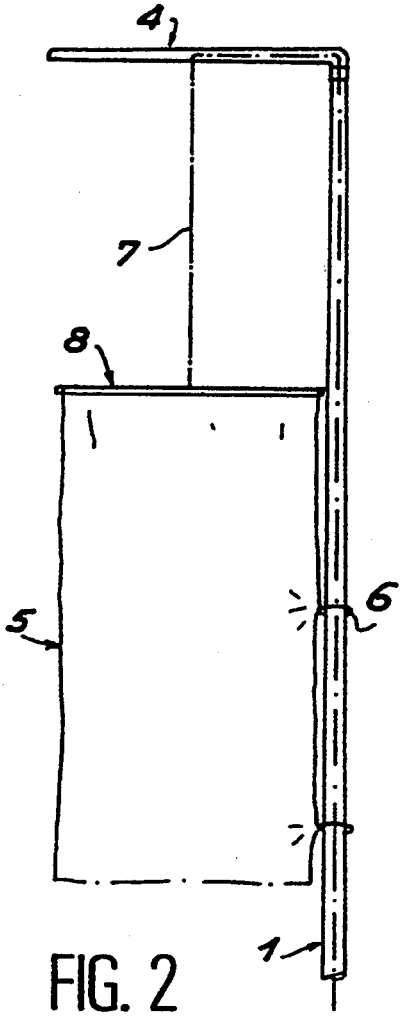
FIG. 2
FIG. 5
FIG. 4
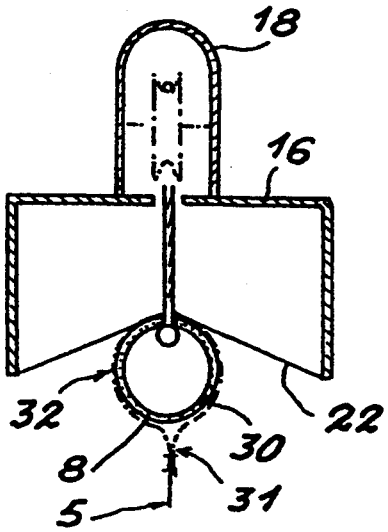

FLAGSTAFF FOR HOLDING THE FLAG UNFURLED

BACKGROUND OF THE INVENTION

This application is based on copending French application No. 9207730, filed Jun. 24, 1992, priority of which is claimed under 35 U.S.C. 119.

The invention relates to a flagstaff constituted by a mast provided with a boom which carries a flag.

Numerous flagstaffs of this type are known, these being very widely used to display flags or ensigns for advertising or decorative purposes, such as, for example, those disclosed in U.S. Pat. Nos. 3,323,486 or 1,712,691.

These flagstaffs have numerous drawbacks, deriving mainly from the fact that the flag can only be put into place or lowered by acting directly on the boom or by manoeuvering the boom itself. The personnel thus has to be equipped with lifting apparatus, or else the mast has to be fitted with lifting devices, which involves the assistance of a specialized maintenance company or highly complex operations when manoeuvering the boom. Another solution is to use masts that can swing between their normal position and a practically horizontal position, but this manoeuvre is often difficult owing to the fact that the masts are installed in the vicinity of a public thoroughfare or a confined space, which is the case, for example, of car dealers.

Now, such drawbacks become prohibitive if we take into account the fact that the flags are manipulated quite frequently since they deteriorate quickly owing to pollution, dust, wind and inclement weather.

Moreover, these difficulties are further aggravated by the fact that use is now made of large-sized flags.

SUMMARY OF THE INVENTION

The object of the present invention is to remedy these drawbacks and, to do so, it provides a flagstaff the flag of which is equipped with a rigid head bar operable from the foot of the mast with the help of a halyard, securing means being provided between the boom and the head bar when the latter has been hoisted to its top position by the halyard. The rigid head bar can be either a shaped piece or bar sewn into a hem, or a shaped piece fitting over a support such as a rope sewn into a hem.

Thus, by operating the halyard, even a non-specialist can easily lower the flag to attend to its upkeep, or replace it, and, just as easily, hoist it and secure it to the boom so as to form a strong, aesthetic whole.

A shoe member can advantageously be fixed to the shaped piece to retain the end of the halyard and, preferably, the shoe member comprises a receptacle suitable for removably receiving the said halyard end.

This enables the halyard to be attached and detached very easily, without removing the flag.

According to a preferred form of embodiment, the receptacle for the shoe member comprises a widened lower portion permitting the passage of the end-piece of the halyard, a narrow upper portion in the shape of a slot permitting the passage of the halyard only, the end-piece of the halyard being retained by a locking neck, at the limit between the lower and upper portions of the said receptacle.

Preferably, the height of the lower portion of the receptacle is at least equal to the height of the end-piece of the halyard.

These features provide a non-limitative illustration of the means of installing the halyard on the head bar.

According to an improved variant, the shaped piece comprises at least one stop to hold the rope and, preferably, a holding stop will be placed at each end of the said shaped piece.

According to a preferred form of embodiment, the stop will be formed by an angle-piece, which locks the rope horizontally and vertically, this angle-piece being fixable to the shaped piece, to come to bear against the rope; advantageously, the shaped piece has a section in the form of an inverted U, the arms of the U being bent towards one another to retain the rope and the flag.

According to another feature of the invention, the securing means are constituted by a housing for the head bar provided beneath the boom, a housing whereof the seating for the head bar flares outwardly; in certain cases, the housing for the head bar provided beneath the boom receives spacer members comprising an outwardly flaring seating for the head bar; advantageously, the spacer members are located at the ends of the said housing.

The head bar and the upper portion of the flag are thus sheltered from inclement weather conditions and are efficiently maintained in the housing beneath the boom, and particularly in the case wherein the said housing comprises spacer members the flaring seating of which further facilitates the installation of the head bar when the flag is hoisted.

According to a preferred form of embodiment of the invention, the halyard is fixed to the central portion of the head bar and then winds round a first pulley carried by the boom.

Advantageously, the shoe member presents a cut out portion, in the vicinity of the pulley when the head bar has been hoisted to top position and, preferably, the said cut out portion is arc shaped so as better to mate with the pulley.

The cut out portion of the shoe member enables the latter to be brought as close as possible to the pulley, when the halyard is in top position; as a result, the head bar is better supported and more sheltered beneath the boom, which considerably attenuates the effects of the different vibrations, including those caused by the wind, hence the risks of the halyard shearing.

Preferably, the first pulley is located in the central portion of the boom.

The head bar is, indeed, maintained as soon as the halyard is, for its part, secured in the vicinity of its central portion, whether the pulley is itself also located in the central portion of the boom, or whether it is located in the vicinity of its end.

However, the former solution ensures that the head bar, hence the flag, is held more firmly, especially if flaring seatings, or spacer members, also flaring, are provided for the head bar at the ends of the housing. Indeed, the traction exerted on the head bar by the halyard at the end of the hoisting operation slightly braces it between these seatings.

According to another improvement falling within the scope of the invention, the halyard travels through the inside of the boom mounted on a rotary head, and then inside the rotary head and the mast, which comprises, in the vicinity of its foot, a halyard handling opening.

The moving parts are then all protected against inclement weather conditions, while the flag can fly freely according the direction of the wind, to the benefit of its useful life and aesthetic appearance.

Advantageously, the edge of the flag adjacent to the mast bears sliding rings passing round the post.

As a result of this arrangement, the flag is always unfurled, even in strong winds. Furthermore, the uppermost ring naturally orientates the upper portion of the flag, hence the head bar, so that its position is more or less parallel to the boom, which facilitates its installation when upon hoisting.

BRIEF DESCRIPTION OF THE DRAWINGS

Two forms of embodiment of the invention will now be described with reference to the annexed drawings, wherein:

FIG. 1 is an overall view of a flagstaff according to the invention;

FIG. 2 is a similar, partial view showing the flag in the process of being hoisted;

FIG. 4 is a cross-sectional view along line 4—4 of FIG. 3;

FIG. 5 is a schematic cross-sectional view of a major variant;

DETAILED DESCRIPTION OF THE PREFERRED EMBODIMENTS

Figure 3:
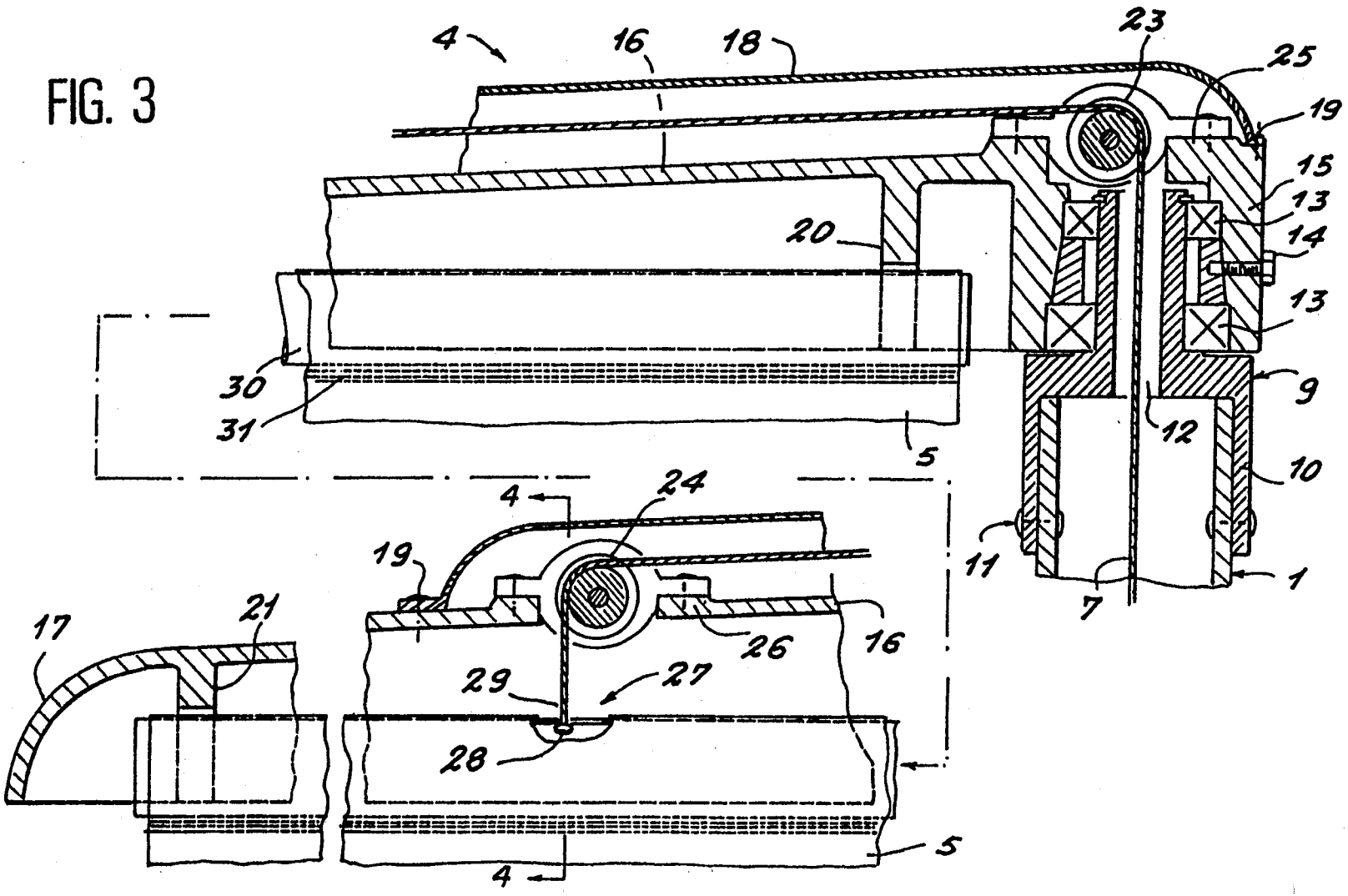
FIG. 3 is a larger-scale, sectional view of the boom and of the upper portions of the flag and of the mast, according to a first form of embodiment.

FIG. 1 shows a mast 1 set vertically in the ground 2 and provided with an opening 3 which can be closed by a cover. This opening is used to manipulate the halyard, which will be discussed later, either inside the mast, or outside it, using conventional processes and means that are outside the scope of the invention.

The mast 1 is topped by a boom 4, which supports a flag 5 having an elongated rectangular shape. Along its edge adjacent to the mast, flag 5 bears a series of rings 6 which pass round the mast. These rings can be fixed to the flag by various means, which are also outside the scope of the invention. The bottom ring is advantageously weighted to ensure that the flag remains unfurled.

FIG. 2 shows the flag in the process of being hoisted or lowered. It can be seen to be suspended from a halyard 7 by means of a rigid head bar 8.

With reference to FIG. 3, it can be seen that the mast 1 is topped by a rotary head 9 comprising a stator 10 fitted over mast 1 and held in place, for example, by bolts 11. Stator 10 is provided with an axial passage 12 for the halyard 7. Rotor 13 of the rotary head is maintained by screw 14 inside a massive foot member 15 of boom 4. The boom is constituted basically by an inverted channel of decreasing cross-section 16 which is integral with the foot member 15 and which ends in an end-piece 17 having the shape of a quarter of a sphere.

Over channel 16 is placed a tunnel 18, held in place by a series of screws, such as 19, on channel 16 itself and on foot member 15.

As better seen in FIG. 4, channel 16 comprises two spacer members 20 and 21 in the vicinity of its two ends. Each spacer member forms a flared seating 22 for head bar 8.

Finally, there are two pulleys, 23 and 24, the flanges of which are screwed onto projections 25 and 26, the first provided astride the foot member 15 and the channel 16, and the second in the central portion of the channel 16, above an orifice.

It can be seen that the halyard, which has travelled along mast 1, passes succcessively around pulley 23, and then around pulley 24, so as to pass through stator 10, and then travel along the inside of tunnel 18, finally reaching the head bar, to which it is fixed by means of an end projection in the shape of a ball, 27, which has been introduced inside the head bar through a hole 28 followed by a slot 29.

In the example illustrated, the rigid head bar is formed by a slightly elastic metallic or plastic shaped piece 30 sewn, at 31, into a hem 32 in flag 5.

According to a variant represented in FIG. 5, the head bar is a shaped piece having an inverted U section, which is also slightly elastic, 33, which fits over a rope 34 sewn at 35 into a hem 36.

It is clear that, from the position represented in FIG. 1, it suffices, in order to lower the flag, to release, via opening 3, halyard 7 which, owing to the weight of the flag and of the head bar, travels over pulleys 23 and 24 and ensures the lowering of flag 5, while rings 6 slide along mast 1.

The flag can then easily be repaired or replaced by extracting ball 27 from slot 29 via hole 28. To hoist the new flag, it suffices to pull on halyard 7, as a result of which flag 5 is hoisted up along the mast until the ends of the head bar 8 are received in seatings 22 of spacer members 20 and 21, the head bar having been guided, at the end of its progress, by the upper ring 6 so as to be in a position at least more or less parallel to boom 4.

By pulling fairly firmly on halyard 7, the head bar 8 can firmly secured, since it is braced, thanks to its slight elasticity, between its two seatings 22.

There is thus obtained a flagstaff the flag of which, thanks to rotary head 9, is orientated according to the direction of the wind and which, most particularly, remains permanently unfurled, since it is maintained along its upper edge against boom 4 by head bar 8, and along its side parallel to the mast, by rings 6.

A second form of embodiment is described, as illustrated in FIGS. 6 to 10.

Figure 6:
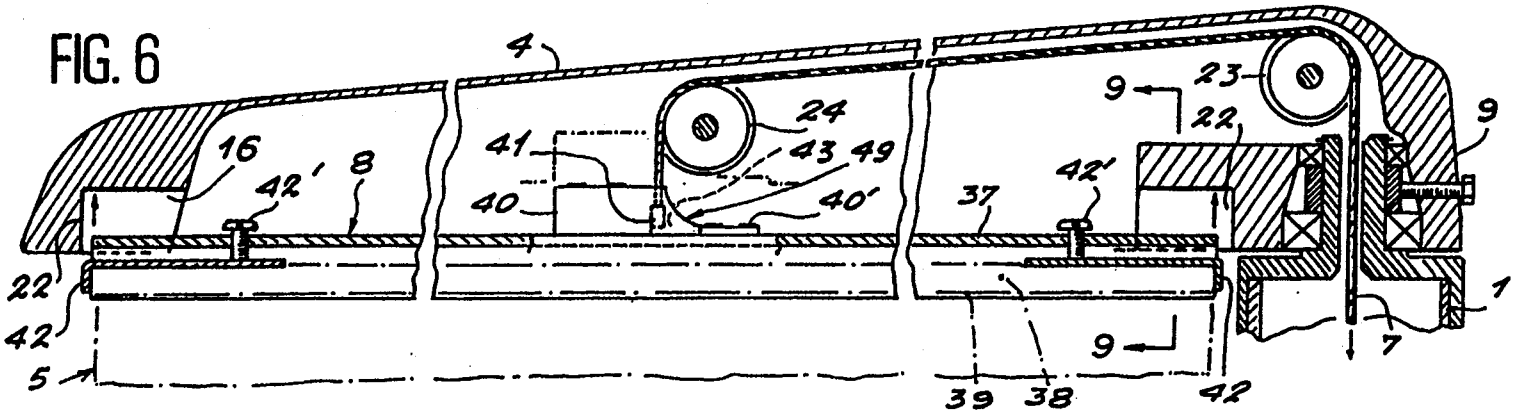
FIG. 6 is a cross-sectional view of a second form of embodiment of the flagstaff according to the invention.

With reference to FIG. 6, it can be seen that mast 1 is topped by a rotary head 9, and we encounter the main elements described previously, in particular the halyard 7, housed inside a boom 4 containing two pulleys 23, 24 the horizontal pins of which are conventionally fixed inside the said boom; pulley 24 is fixed very high up inside the boom without, however, impeding the passage of the halyard.

Figure 9:
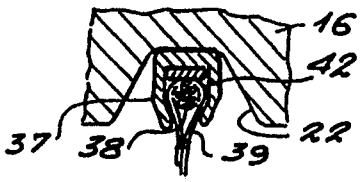
FIG. 9 is a cross-sectional view along line 9—9 of FIG. 6.
Figure 8:
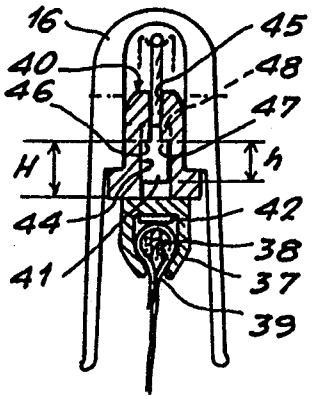
FIG. 8 is a cross-sectional view along line 8—8 of FIG. 7.
Figure 7:
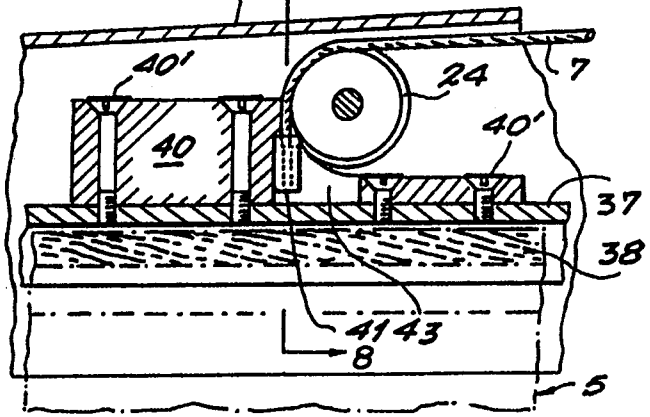
FIG. 7 is shows a detail of FIG. 6 representing in a larger scale cross-sectional view the central portion of the boom and the central upper portions of the flag.

As can also be seen from FIGS. 8 and 9, the boom is basically constituted by an inverted channel with a decreasing cross-section 16, and it has a flared seating 22 at each end to receive head bar 8 when the latter is hoisted to its top position.

The head bar is formed by a slightly elastic metallic or plastic shaped piece 37, in the form of an inverted U, fitting over a support 38, such as a rope, sewn into a hem 39.

A shoe member 40 is fixed, by means of screws 40', to shaped piece 37 in its central portion, vertically in relation to pulley 24; other means for fixing the shoe member to the shaped piece could be devised, without thereby departing from the scope of the present invention.

Two stops 42 in the form of angle pieces are fixed by screws 42', each at one end of the shaped piece, after being slid inside the latter, and help to hold the rope firmly inside the shaped piece.

The halyard end 41 is slid and retained inside shoe member 40 in a receptacle 43 designed for, and capable of, removably receiving it.

Figure 10:
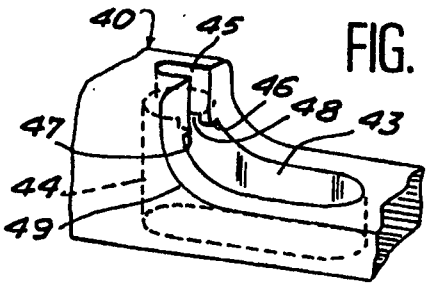
FIG. 10 is a partial perspective view, on a larger scale, of the shoe member and its receptacle.

As can be seen, in particular, from FIG. 10; the receptacle comprises a fairly wide lower portion 44, permitting the passage of end-piece 41 of the halyard, a narrower slot-shaped upper portion 45 permitting the passage of the halyard only and preventing the passage of the latter's end-piece.

Two notches, 46, 47, are provided at the limit between the lower portion and the upper portion of the receptacle, thus creating a locking neck 48 for the end of the halyard.

The height H of the lower portion of the receptacle is greater than the height h of the end-piece of the halyard, which makes it possible to slide the said end-piece inside the said receptacle without having to remove the shoe member.

A flag already fitted with its head bar can thus be replaced very quickly.

The second form of embodiment operates in a manner similar to that of the first one. However, thanks, in particular, to the very high position of pulley 24, it enables the head bar to be raised as high as possible inside the boom; this advantage is further increased in that the shoe member has an arc shaped cut out portion 49 thanks to which, in top position, it mates with the pulley, with the shaped piece fitting into the position represented in FIGS. 7, 8 and 9, and in dotted lines in FIG. 6.

This form of embodiment is very advantageous since, as a result of bringing the head bar inside the boom, it is insulated from vibrations, in particular vibrations dues to the wind, and the halyard is no longer subjected to shearing phenomena liable to impair its strength.

It is of particular interest to note that, thanks to the invention, mast 1 does not need to be designed so as to swing; the maintenance teams do not have to be equipped with lifting means, it being possible for a small number of non-specialist personnel to attend to the lowering, maintenance, replacement and the hoisting of the flag swiftly and easily.

It goes without saying that the invention is not limited to the forms of embodiment described. For example, the mast is not necessarily vertical; the boom, which does not need to be rotary, is not necessarily perpendicular to the mast. It can terminate well before the end of the head bar beyond pulley 24; the shaped pieces used to form the head bar can be made of any sufficiently rigid material and can have cross-sections adapted to requirements; the structures of the different parts, such as the boom, the shape piece, the shoe member, the receptacle, etc., can vary without thereby departing from the scope of the invention.

What is claimed is:

1. A flagstaff and flag assembly for maintaining a flag unfurled, in the absence of wind, comprising:

a mast (1) having a top and an opposite foot, provided with a horizontal boom (4) substantially coextensive with a head bar (8), which carries a flag (5), said boom containing a pulley, said head bar (8) being capable of being raised and lowered in relation to said horizontal boom (4) from said foot of the mast by a halyard (7), said halyard having first and second ends, said first end fixedly connected to said head bar (8) and said halyard passing around said pulley and extending to said foot of the mast (1) and wherein a side edge of the flag adjacent to the mast carries sliding rings (6) passing around the mast.

2. A flagstaff and flag assembly as claimed in claim 1, wherein:

the rigid head bar is a shaped piece (30) sewn into a hem (32) on said flag.

3. A flagstaff and flag assembly as claimed in claim 1, wherein:

the rigid head bar is a shaped piece (33) fitting over a support such as a rope (34) sewn into a hem (36) on said flag.

4. A flagstaff and flag assembly as claimed in claim 1, wherein:

the head bar is a shaped piece (37) fitting over a support such as a rope sewn into a hem (39), and a shoe member (40) fixed on the shaped piece to retain said halyard first end (41).

5. A flagstaff and flag assembly as claimed in claim 4, wherein:

the shoe member comprises a receptacle (43) suitable for receiving said halyard first end.

6. A flagstaff and flag assembly as claimed in claim 5, wherein;

the receptacle has a widened lower portion (44) permitting the passage of said halyard first end, said halyard first end further having an end-piece (41), a narrow upper portion (45) permitting the passage of the halyard (7), and said halyard first end end-piece (41) of the halyard being retained by a locking neck (48) formed within said receptacle.

7. A flagstaff and flag assembly as claimed in claim 6, wherein:

the height (H) of the lower portion (44) of the receptacle is greater than the height (h) of the end-piece (41) of the halyard.

8. A flagstaff and flag assembly as claimed in claim 3, wherein:

the shaped piece (33 and 37) comprises at least one stop (42) which is capable of maintaining the rope (34 and 38) inside the shaped piece.

9. A flagstaff and flag assembly as claimed in claim 1, wherein:

a housing (16) for the head bar is provided beneath the boom, said housing having two ends and an outwardly flared seating for the head bar.

10. A flagstaff and flag assembly as claimed in claim 1, wherein:

a housing (16) for the head bar is provided beneath the boom (4), said housing having two ends, and spacer members (20, 21) are received in said housing, said spacer members defining an outwardly flared seating for the head bar (8).

11. A flagstaff and flag assembly as claimed in claim 10, wherein:

the spacer members are provided at said ends of said housing.

12. A flagstaff and flag assembly as claimed in claim 1, wherein:

said halyard first end (7) is fixed to a central portion of the head bar (8).

13. A flagstaff and flag assembly as claimed in claim 12, wherein:

the pulley is located in a central portion of the boom.

14. A flagstaff and flag assembly as claimed in claim 13, wherein:

said headbar includes a shoe member to retain said halyard first end; and said shoe member presents a cut out portion (49) in the vicinity of the pulley when the head bar has been hoisted to a top position.

15. A flagstaff and flag assembly as claimed in claim 14, wherein:

the cut out portion is arc shaped.

16. A flagstaff and flag assembly as claimed in claim 1, wherein:

the halyard (7) travels inside the boom (4) mounted on a rotary head (9), and then inside the rotary head and the mast (1), which has a handling opening (3) in said opposite foot.

* * * * *